US005540278A

United States Patent [19]

Chiba et al.

[11] Patent Number: 5,540,278

[45] Date of Patent: Jul. 30, 1996

[54] HEAT EXCHANGER

[75] Inventors: Tomohiro Chiba, Isesaki; Hisao Aoki, Maebashi; Rei Oikawa, Isesaki, all of Japan

[73] Assignee: Sanden Corporation, Isesaki, Japan

[21] Appl. No.: 456,317

[22] Filed: Jun. 1, 1995

Related U.S. Application Data

[63] Continuation of Ser. No. 233,951, Apr. 28, 1994, abandoned.

[30] Foreign Application Priority Data

| | | | |
|---|---|---|---|
| Apr. 30, 1993 | [JP] | Japan | 5-103839 |
| Aug. 31, 1993 | [JP] | Japan | 5-52330 |
| Sep. 21, 1993 | [JP] | Japan | 5-259178 |
| Sep. 21, 1993 | [JP] | Japan | 5-259179 |
| Sep. 28, 1993 | [JP] | Japan | 5-57424 |

[51] Int. Cl.[6] ..... F28F 9/02

[52] U.S. Cl. ..... 165/175; 165/173; 165/906

[58] Field of Search ..... 165/76, 151, 153, 165/173–175, 906

[56] References Cited

U.S. PATENT DOCUMENTS

| | | | |
|---|---|---|---|
| 1,812,339 | 6/1931 | Horne et al. | 165/174 |
| 1,847,743 | 3/1932 | Anderson | 165/76 |
| 4,396,060 | 8/1983 | Schenk . | |
| 4,969,512 | 11/1990 | Aoki et al. . | |
| 5,036,914 | 8/1991 | Nishishita et al. | 165/173 |
| 5,211,222 | 5/1993 | Shinmura . | |
| 5,299,635 | 4/1994 | Abraham | 165/173 |
| 5,343,620 | 9/1994 | Velluet | 165/173 X |

FOREIGN PATENT DOCUMENTS

| | | | |
|---|---|---|---|
| 302592 | 12/1990 | Japan | 165/174 |
| 36497 | 2/1991 | Japan | 165/173 |
| 60485 | 3/1993 | Japan | 165/175 |
| 1546808 | 2/1990 | U.S.S.R. | 165/174 |
| 844466 | 8/1960 | United Kingdom | 165/906 |

*Primary Examiner*—Leonard R. Leo
*Attorney, Agent, or Firm*—Baker & Botts, L.L.P.

[57] ABSTRACT

A heat exchanger includes upper and lower tanks, a plurality of parallel heat transfer tubes fluidly interconnected between the upper and lower tanks, a plurality of reinforcing members connecting an upper wall and a lower wall of the upper and lower tanks, and a communication path associated with each reinforcing member. The reinforcing members increase the strength of the tank walls against deformation due to the high pressure working fluid without increasing the thickness of the walls or increasing the spacing between the tubes. The communication path ensures efficient flow of a heat medium in the tanks.

3 Claims, 17 Drawing Sheets

HEAT EXCHANGER

This application is a continuation of application Ser. No. 08/233,951, filed Apr. 28, 1994 abandoned.

BACKGROUND OF THE INVENTION

1. Field of the Invention

The present invention relates to a heat exchanger suitable for use in an air conditioning system for vehicles, and more particularly to an improved heat exchanger having a pair of tanks and a plurality of heat transfer tubes interconnected therebetween.

2. Description of the Related Art

FIGS. 26 to 28 depict a conventional heat exchanger used in an air conditioning system, for example, an evaporator or a condenser. In FIGS. 26 and 27, a heat exchanger 101 includes an upper tank 102 and a lower tank 103. Upper tank 102 includes an upper wall 102*a* and a lower wall 102*b*. Lower tank 103 includes an upper wall 103*a* and a lower wall 103*b*. A plurality of heat transfer tubes 104 are fluidly interconnected between lower wall 102*b* of upper tank 102 and upper wall 103*a* of lower tank 103. Inlet pipe 105 and outlet pipe 106 are connected to upper tank 102. A heat medium, for example, refrigerant, introduced into inlet pipe 105 flows in heat exchanger 101 from inlet pipe 105 to outlet pipe 106, for example, as shown in FIG. 29. When the heat medium flows through heat transfer tubes 104, heat exchange between the heat medium and air flow 107 passing through the heat transfer tubes 104 is performed.

In such a conventional heat exchanger, however, because each tank 102, 103 is formed from a thin and flat plate (for example, aluminum plate or aluminum alloy plate), the tank walls may become deformed, as shown by the dashed lines in FIGS. 26–28, when the pressure in the tanks exceeds a certain level. Upper wall 102*a* of upper tank 102 and lower wall 103*b* of lower tank 103 are particularly likely to be deformed.

In addressing this problem, two alternative tank constructions have been proposed. The first employs relatively thicker plates, while in the second, partitions are used to connect the upper and lower walls. The former construction increases the weight and cost of the heat exchanger. The latter construction requires a complicated mold for forming a tank, and also increases the cost of the heat exchanger. Further, if too many partitions are disposed in the tank, the heat medium encounters higher fluid resistance. This reduces the efficiency of the heat exchanger.

SUMMARY OF THE INVENTION

It is an object of the present invention to provide a heat exchanger with tanks having a sufficiently high degree of internal pressure resistance without using a thick plate material, and to manufacture inexpensively a compact, lightweight and efficient heat exchanger.

These and other objects are achieved by a heat exchanger comprising an upper tank and a lower tank, a plurality of parallel heat transfer tubes fluidly interconnecting the upper and lower tanks, a plurality of reinforcing means and a communication path. The plurality of reinforcing means reinforce at least one of the upper and lower tanks by connecting the upper and lower walls of the tank. A communication path is formed on or between the plurality of reinforcing means for communicating the interior of each heat transfer tube with the interior of at least one of the upper and lower tanks.

A heat exchanger according to the present invention may be constructed by one of the following preferred embodiments.

In a first preferred embodiment, each of the reinforcing means is formed by one of the plurality of heat transfer tubes. The heat transfer tube according to the first embodiment extends into the interior of at least one of the upper and lower tanks through one of the upper and lower walls thereof. A tip of the heat transfer tube is connected to the upper wall of the upper tank or the lower wall of the lower tank. An opening is formed on the portion of the heat transfer tube positioned in the interior of the at least one of the upper and lower tanks.

This embodiment may be modified to include a plurality of recessed portions formed on the upper wall of the upper tank or the lower wall of the lower tank. Then, the tip portion of each of heat transfer tubes may be inserted into corresponding recessed portions.

In a second preferred embodiment, the reinforcing means is formed by the plurality of heat transfer tubes. The heat transfer tube according to the second embodiment extends into the interior of at least one of upper and lower tanks through one of the upper and lower walls thereof. A tip of the heat transfer tube is connected to the upper wall of the upper tank or the lower wall of the lower tank. The tip portion of the heat transfer tube positioned in the interior of the at least one of upper and lower tanks has an enlarged diameter portion. An opening is formed on the enlarged diameter portion.

The enlarged diameter portion may be formed as a cup-like portion opening toward the outer wall, or formed by cutting the tip portion into a plurality of flared strips. In the latter case, the communication path is formed by spreading the plurality of strips in a taper form so that the strips open toward the outer wall.

In a third preferred embodiment, a plurality of protrusions are formed on the wall opposite the wall through which the plurality of heat transfer tubes penetrate. The reinforcing means comprises the connection between the tip portion and the protrusion portions. The tip portion has an opening for communicating with the interior of the tank.

In a fourth preferred embodiment, the reinforcing means comprise a plurality of cylindrical walls connecting the upper and lower walls of at least one of upper and lower tanks. The cylindrical walls are formed by pressing at least one of the upper and lower walls into a cylindrical shape so that they project through interior of the tank. An opening is formed on each cylindrical wall for communicating with the interior of the tank. The tips of the heat transfer tubes are inserted into the cylindrical walls.

In this embodiment, the cylindrical walls may be formed by deformation of only one of the walls of the tanks, preferably the one in which the heat transfer tubes are inserted. Alternatively, the cylindrical walls may be formed by deforming both the upper and lower walls, In a fifth preferred embodiment, each of the reinforcing means comprises a column member connecting the upper and lower walls of at least one of upper and lower tanks. The column member is disposed between the heat transfer tubes. The space between the column members forms a communication path through which the refrigerant flows in the tank. The column member preferably comprises a pin or a pipe.

In the heat exchanger according to the preferred embodiments, the reinforcing means increases the internal resistance of tank walls against deformation due to the pressure of the working fluid. The reinforcing means of the preferred embodiments increase the strength of tank walls without increasing the thickness thereof and increasing the pitch of the arrangement of the heat transfer tubes. The communication paths associated with the reinforcing means maintain efficient flow of the heat medium to, from and within the tank. As a result, a compact, light-weight and strong heat exchanger with high efficiency can be inexpensively manufactured.

Further objects, features, and advantages of the present invention will be understood from the detailed description of the preferred embodiments of the present invention with reference to the appropriate figures.

BRIEF DESCRIPTION OF THE DRAWINGS

Some preferred exemplary embodiments of the invention will now be described with reference to the appropriate figures, which are given by way of example only, and are not intended to limit the present invention.

DETAILED DESCRIPTION OF THE PREFERRED EMBODIMENTS

Figure 1:
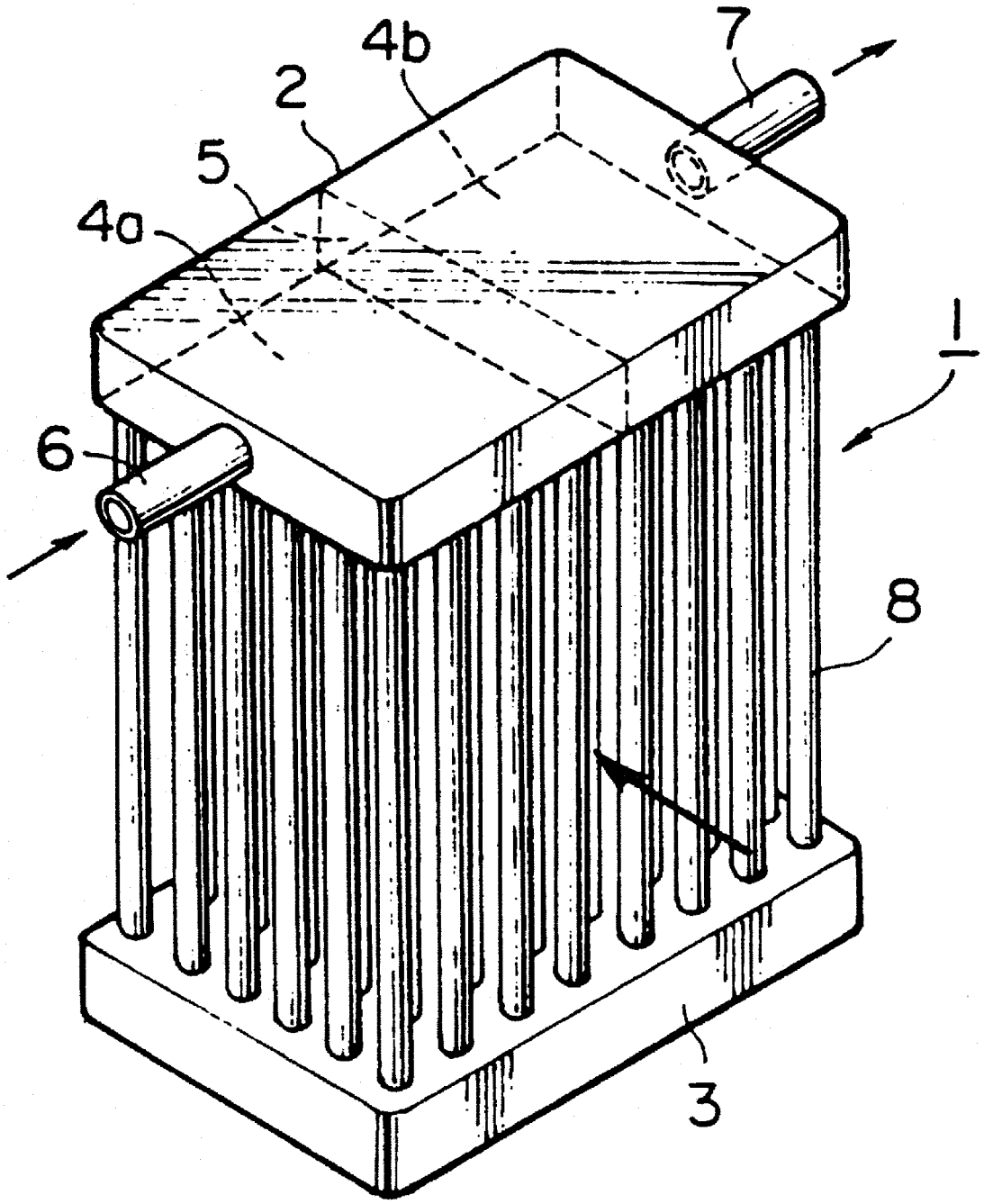
FIG. 1 is a perspective view of a heat exchanger according to a first preferred embodiment.
Figure 2:
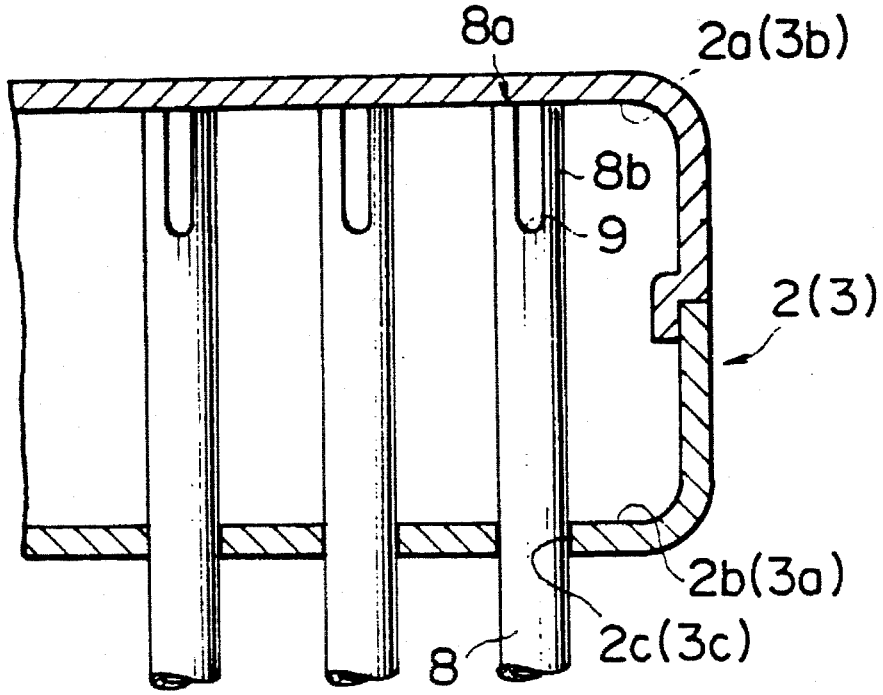
FIG. 2 is an enlarged partial vertical sectional view of the heat exchanger depicted in FIG. 1.

Referring to FIGS. 1 and 2, a heat exchanger 1 is provided according to a first preferred embodiment. Heat exchanger 1 includes an upper tank 2 and a lower tank 3. The inside of upper tank 2 is divided into two chambers 4*a* and 4*b* by a partition 5. Inlet pipe 6 and outlet pipe 7 are connected to upper tank 2. A plurality of heat transfer tubes 8 (for example, refrigerant tubes) are fluidly interconnected between tanks 2 and 3. Heat transfer tubes 8 are arranged in the longitudinal and transverse directions of heat exchanger 1. Each tube 8 has a circular cross section. Upper and lower tanks 2 and 3 and heat transfer tubes 8 are preferably fabricated from an aluminum or an aluminum alloy.

With reference to FIG. 2, upper tank 2 comprises an upper wall 2*a* and a lower wall 2*b*. Lower tank 3 comprises an upper wall 3*a* and a lower wall 3*b*. Heat transfer tubes 8 extend through holes 2*c* defined on lower wall 2*b* of upper tank 2 and holes 3*c* defined on upper wall 3*a* of lower tank 3 into the interior of upper and lower tanks 2 and 3. The tips 8*a* of each heat transfer tube 8 are brought into contact with the inner surface of upper wall 2*a* of upper tank 2 and the inner surface of lower wall 3*b* of lower tank 3, respectively. Tips 8*a* are preferably connected to walls 2*a* and 3*b* by brazing. The periphery of each heat transfer tube 8 is preferably fixed to the inner edges of holes 2*c* and 3*c* by brazing.

Openings 9 are formed on each heat transfer tube 8 at locations within the interior of upper and lower tanks 2 and 3. Although openings 9 are shown as being formed near upper wall 2*a* or lower wall 3*b*, they may be formed anywhere along the portions of tubes 8 disposed within tanks 2, 3. Openings 9 are preferably formed as U-shaped slots on each end portion 8*b*. Each opening 9 allows the interior of each heat transfer tube 8 to communicate with the interior of upper tank 2 or lower tank 3.

In the first preferred embodiment, upper and lower walls 2*a* and 2*b* of upper tank 2 are connected to each other via heat transfer tubes 8. Similarly, upper and lower walls 3*a* and 3*b* of lower tank 3 are connected to each other via heat transfer tubes 8. Through these connections, the strength of tanks 2 and 3, particularly the internal resistance to deformation due to the pressurized fluid flowing therethrough, can be greatly increased without increasing the thickness of the plate material from which the tanks are formed and without providing unnecessary partitions in the tanks. Therefore, a compact and light-weight heat exchanger can be obtained inexpensively.

The above-described structure for reinforcing tanks 2 and 3 can be achieved without changing the pitch of the arrangement of heat transfer tubes 8. Moreover, an efficient flow of working fluid from the interior of each heat transfer tube 8 to the interior of upper tank 2 or lower tank 3 is ensured by each communication path 9. Consequently, an efficient, durable and inexpensive heat exchanger is obtained.

Although the reinforcing and communication structure is formed in both tanks 2 and 3 in the first preferred embodiment, the structure may alternatively be applied to only one of the upper and lower tanks 2 and 3.

Figure 3:
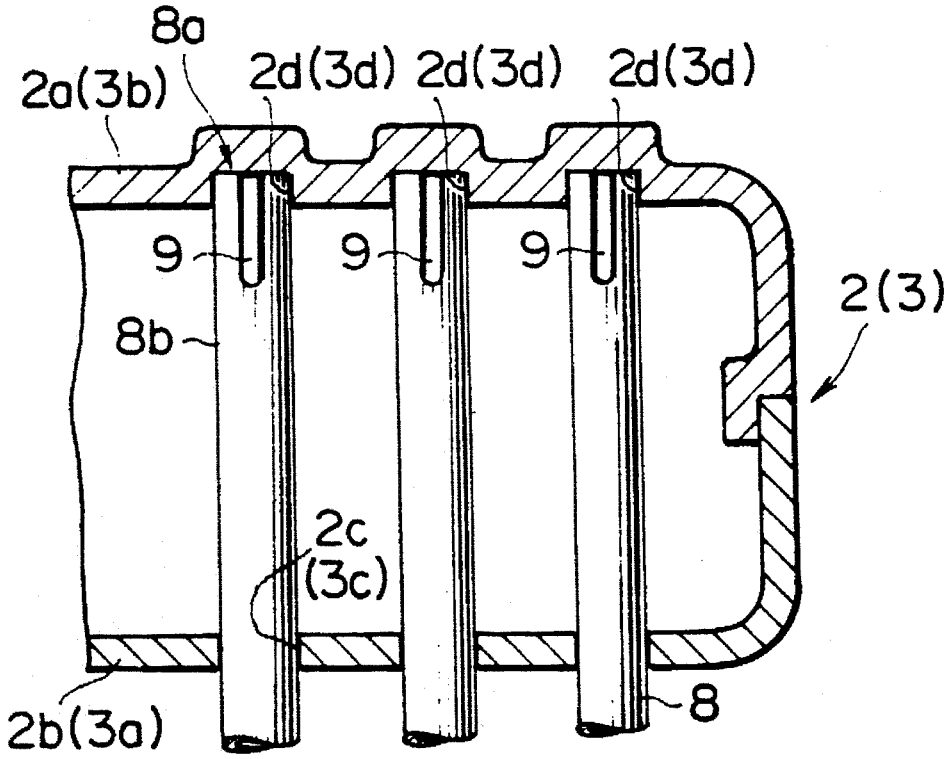
FIG. 3 is a partial vertical sectional view of a heat exchanger according to a modification of the heat exchanger depicted in FIG. 2.

FIG. 3 depicts a modification of the first embodiment. In this embodiment, a plurality of recessed portions 2*d* and 3*d* are formed on upper wall 2*a* of upper tank 2 and lower wall 3*b* of lower tank 3. Upper tip portion 8*b* and lower tip portion 8*b* of each heat transfer tube 8 are inserted into corresponding recessed portion 2*d* and recessed portion 3*d*, respectively. Tip portion 8*a* and tip portion 8*b* are brazed to the inner surface of each recessed portion 2*d* or 3*d*.

In such a structure including recessed portions, tip portion 8*a* and tip portion 8*b* of heat transfer tube 8 are fixed. to tank wall 2*a* or 3*b* more strongly. Therefore, the internal resistance against the pressure of the working fluid can be further increased.

Figure 4A:
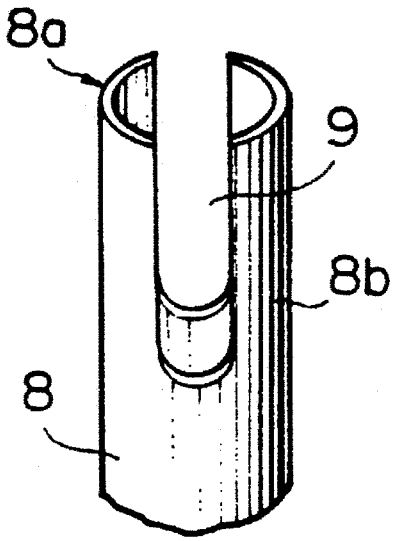
FIGS. 4A to 4D are partial perspective views of heat transfer tubes of heat exchangers according to the first preferred embodiment.
Figure 4B:
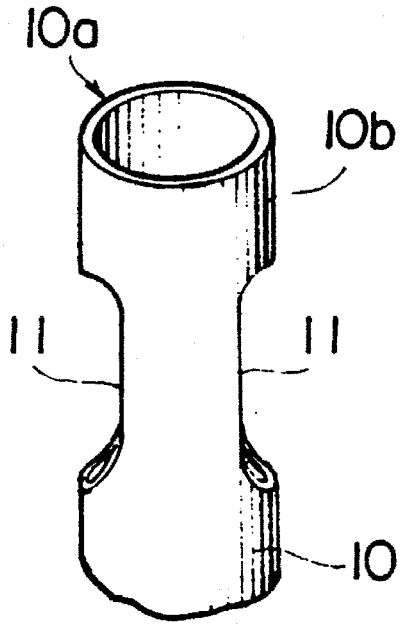
Figure 4C:
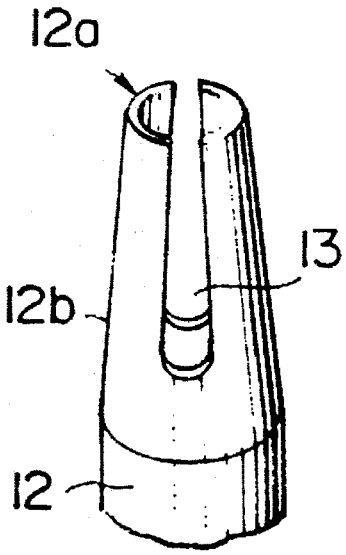
Figure 4D:
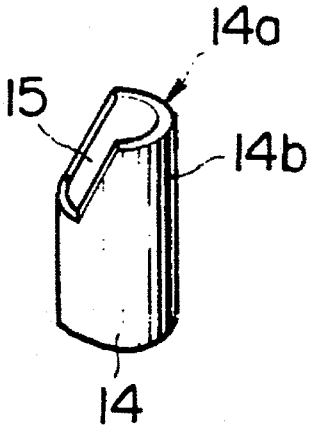

In the foregoing embodiments, the end portion 8*a* and the opening 9 can be modified in various shapes and structures, for example, as shown in FIGS. 4A to 4D. The structure shown in FIG. 4A is substantially the same as that shown in FIGS. 2 and 3. In the structure shown in FIG. 4B, long holes or slots 11 are formed on opposite sides of tube 10 near tip portion 10*b*. In the structure shown in FIG. 4C, each tip portion 12*b* of heat transfer tube 12 is tapered. Slots 13 extend from tip 12*a* with a width increasing away from tip 12*a* in the axial direction of tube 12. In the structure shown in FIG. 4D, each tip portion 14*b* of heat transfer tube 14 is obliquely cut away to define a communication path 15.

Figure 5:
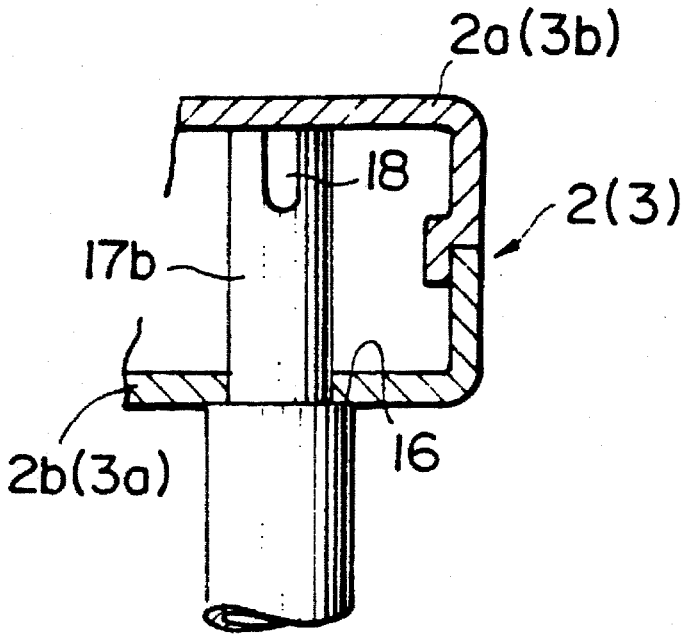
FIG. 5 is a partial vertical sectional view of a heat exchanger according to another modification of the heat exchanger depicted in FIG. 2.

FIG. 5 depicts another modification of the first embodiment. In this modification, a stepped portion 16 is formed on each heat transfer tube 17 at each end portion 17*b* thereof. Stepped portion 16 abuts the outer surface of lower wall 2*b* of upper tank 2 or upper wall 3*a* of lower tank 3. A communication path 18 is formed on each tip portion of each heat transfer tube 17 in a manner similar to that of the first embodiment.

Figure 6:
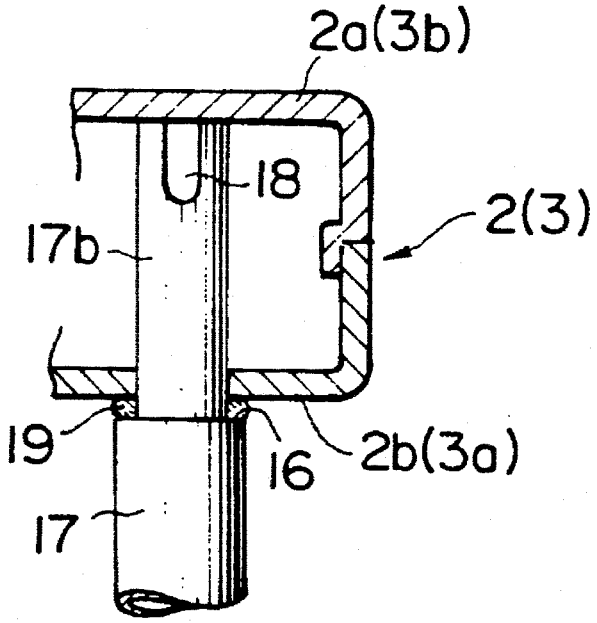
FIG. 6 is a partial vertical sectional view of the heat exchanger depicted in FIG. 5, showing a preferred manufacturing method for the heat exchanger.

As shown in FIG. 6, if there is a dimensional inaccuracy in the longitudinal direction of heat transfer tubes 17, a molten brazing material 19 may be pooled on the stepped portion 16 so that heat transfer tube 17 can be surely brazed.

Figure 7:
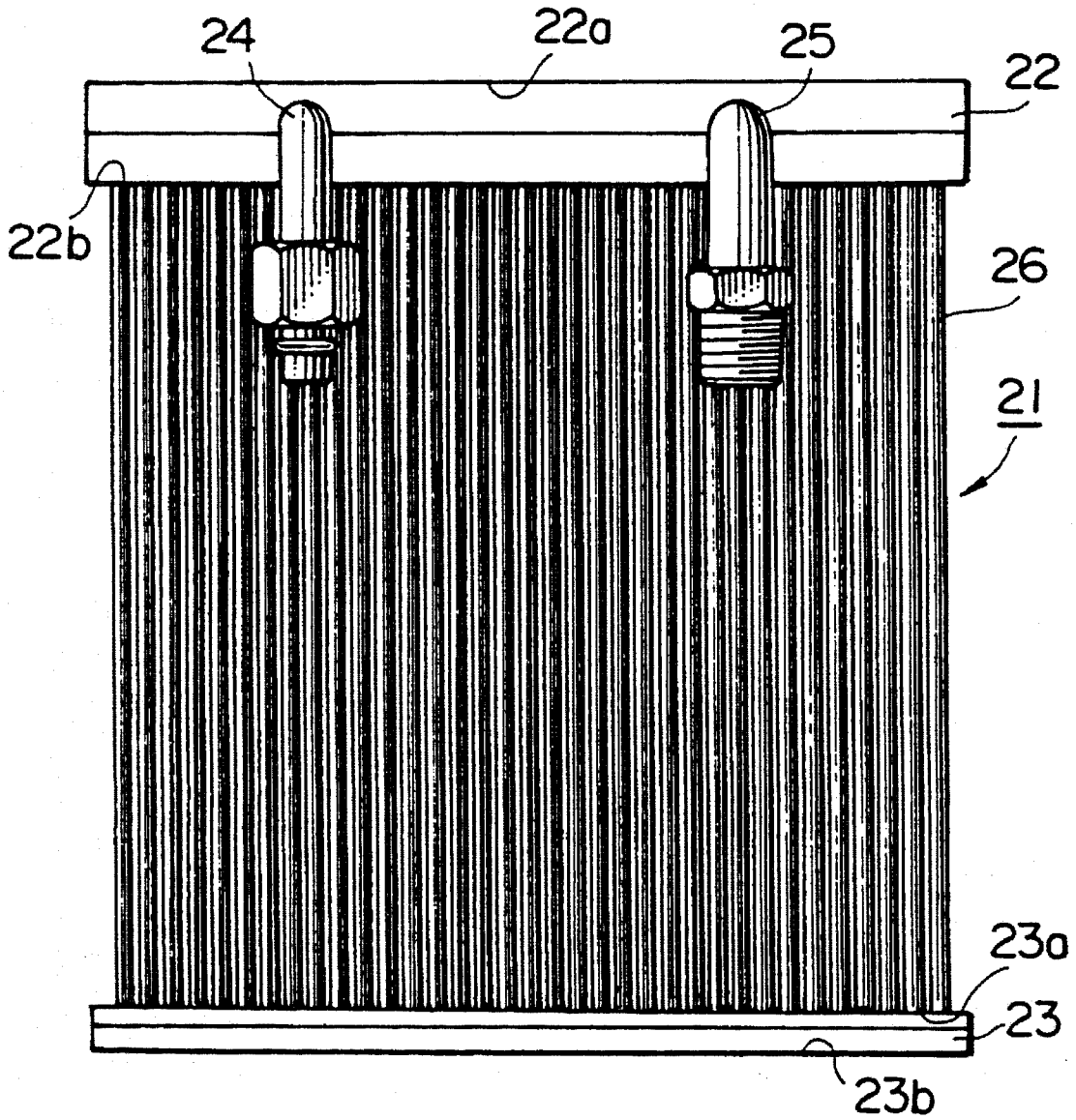
FIG. 7 is an elevational view of a heat exchanger according to a second preferred embodiment.
Figure 8:
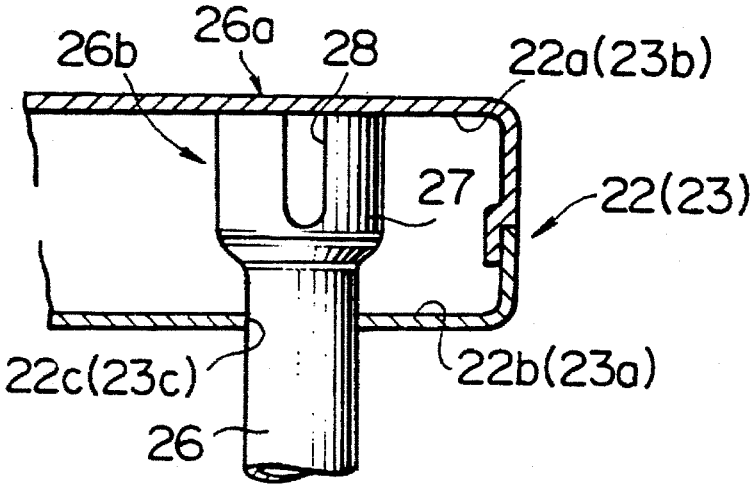
FIG. 8 is an enlarged partial vertical sectional view of the heat exchanger depicted in FIG. 7.
Figure 9:
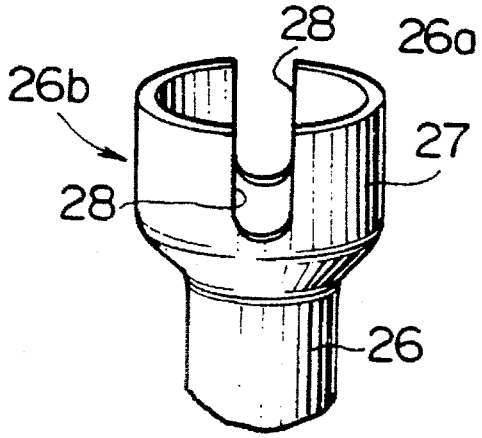
FIG. 9 is a perspective view of an enlarged diameter portion of a heat transfer tube depicted in FIG. 8.

FIGS. 7 to 9 depict a second preferred embodiment. Heat exchanger 21 includes an upper tank 22 and a lower tank 23. Inlet pipe 24 and outlet pipe 25 are connected to upper tank 22. A plurality of heat transfer tubes 26 (for example, refrigerant tubes) are fluidly interconnected between tanks 22 and 23. Upper tank 22 comprises an upper wall 22*a* and a lower wall 22*b*. Lower tank 23 comprises an upper wall 23*a* and a lower wall 23*b*. Each heat transfer tube 26 extends through holes 22*c* formed on lower wall 22*b* of upper tank 22 and holes 23*c* formed on upper wall 23*a* of lower tank 23 and into the interior of upper and lower tanks 22 and 23. A tip 26*a* of each heat transfer tube 26 is brought into contact with the inner surface of upper wall 22*a*, and another tip 26*a* is brought into contact with the inner surface of lower wall 23*b*. Tips 26*a* are connected to these walls 22*a* and 23*b* by brazing. The periphery of each heat transfer tube 26 is fixed to the inner edges of holes 22*c* and 23*c* by brazing.

An enlarged diameter portion 27 is formed on each tip portion 26*b* of each heat transfer tube 26 and is positioned in the interior of upper tank 22 or lower tank 23. Each enlarged diameter portion 27 has a cup-like shape opening toward upper wall 22*a* or lower wall 23*b*. Openings 28 form a communication path on each enlarged diameter portion 27. Although enlarged diameter portion 27 is preferably formed on each tip portion 26*b*, it may be formed on only one tip portion 26*b* of each heat transfer tube 26. Alternatively, the heat exchanger may employ some tubes 26 with enlarged diameter portions 27 at both ends thereof, while the remainder of the tubes 26 have enlarged diameter portion 27 at only one end thereof.

Since opening 28 is formed on enlarged diameter portion 27, opening 28 can be easily manufactured even if the diameter of heat transfer tube 26 is small. Further, opening 28 can be relatively large since it is formed on an enlarged diameter portion 27. Therefore, the structural integrity of heat exchanger 21 is improved, and an efficient flow of a heat medium in tanks 22 and 23 is obtained.

Figure 10:
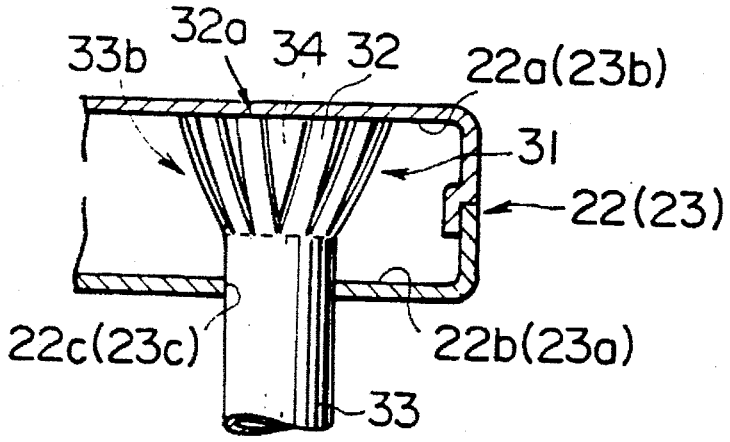
FIG. 10 is a partial vertical sectional view of a heat exchanger according to a modification of the heat exchanger depicted in FIG. 8.
Figure 11:
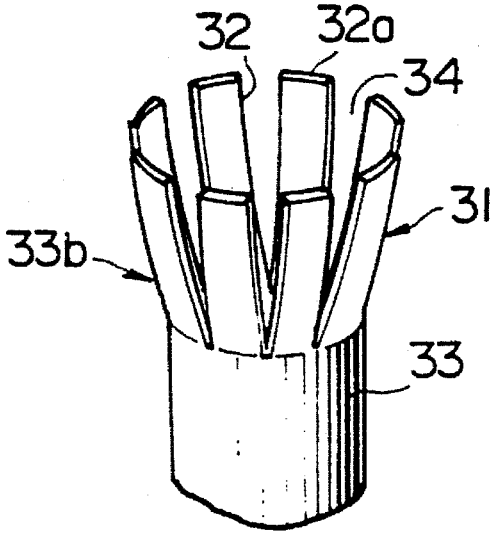
FIG. 11 is a perspective view of an enlarged diameter portion of a heat transfer tube depicted in FIG. 10.

FIGS. 10 and 11 depict a modification of the second embodiment. In this modification, an enlarged diameter portion 31 is formed by dividing tip portion 33*b* into a plurality of strips 32 and spreading the strips 32 so that the strips 32 flare toward upper wall 22*a* of upper tank 22 or lower wall 23*b* of lower tank 23. The plurality of spaces 34 between adjacent flared strips 32 forms a communication path. Tips 32*a* are connected to the inner surface of upper wall 22*a* of upper tank 22 or lower wall 23*b* of lower tank 23 by brazing.

Figure 12:
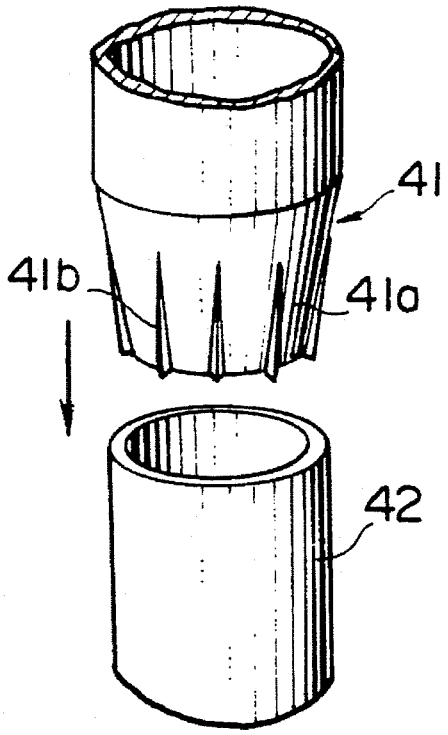
FIG. 12 is a perspective view of an end portion of a heat transfer tube and a jig, showing a method for forming the enlarged diameter portion depicted in FIG. 11.

Enlarged diameter portion 31 is formed by substantially a single process, for example, as shown in FIG. 12. In FIG. 12, a jig 41 having a taper portion 41*a* and a plurality of blades 41*b* provided on the taper portion 41*a* is pressed into a pipe 42 which eventually becomes heat transfer tube 33. Accordingly, spread strips 32 and communication paths 34 can be formed substantially simultaneously.

Figure 13:
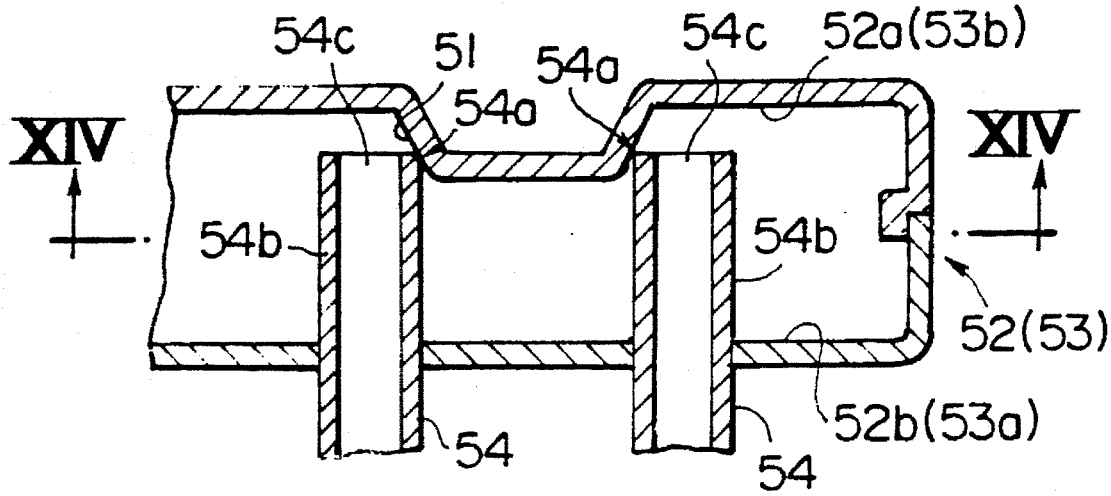
FIG. 13 is a partial vertical sectional view of a heat exchanger according to a third preferred embodiment.
Figure 14:
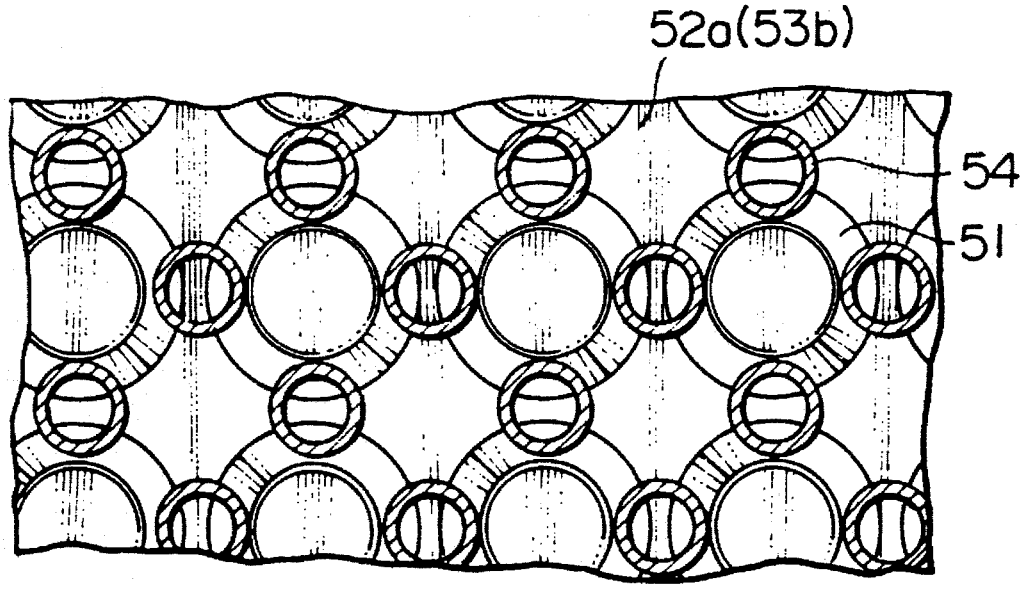
FIG. 14 is a cross sectional view of the heat exchanger depicted in FIG. 13, taken along line XIV—XIV of FIG. 13.

FIGS. 13 and 14 depict a third preferred embodiment. In this embodiment, a plurality of protrusion portions 51 are formed on upper wall 52*a* of upper tank 52 or lower wall 53*b* of lower tank 53, that is, a wall opposite to lower wall 52*b* or upper wall 53*a* through which heat transfer tubes 54 extend. Protrusion portions 51 extend into the interior of tanks 52, 53. Heat transfer tubes 54 comprise pipes. In this embodiment, four heat transfer tubes 54, more specifically, the outer edges 54*a* of the tip portions 54*b*, are brazed to each protrusion portion 51. Openings 54c provide a fluid communication path between the interiors of heat transfer tubes 54 and the interior of tank 52 or 53.

Since upper and lower walls of tank 52 or 53 are connected by protrusion portions 51 and tip portions 54*b*, the strength of tanks 52, 53 can be effectively increased. Since protrusion portions 51 can be readily formed by pressing and it is not necessary to process the end portions of heat transfer tubes 54, the manufacture of this heat exchanger is simplified.

Figure 15:
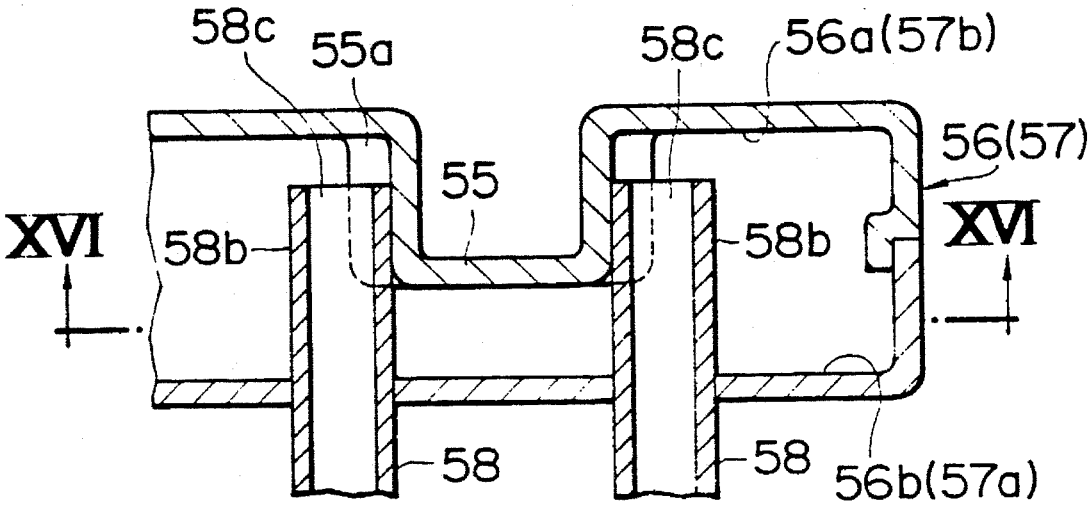
FIG. 15 is a partial vertical sectional view of a heat exchanger according to a modification of the heat exchanger depicted in FIG. 13.
Figure 16:
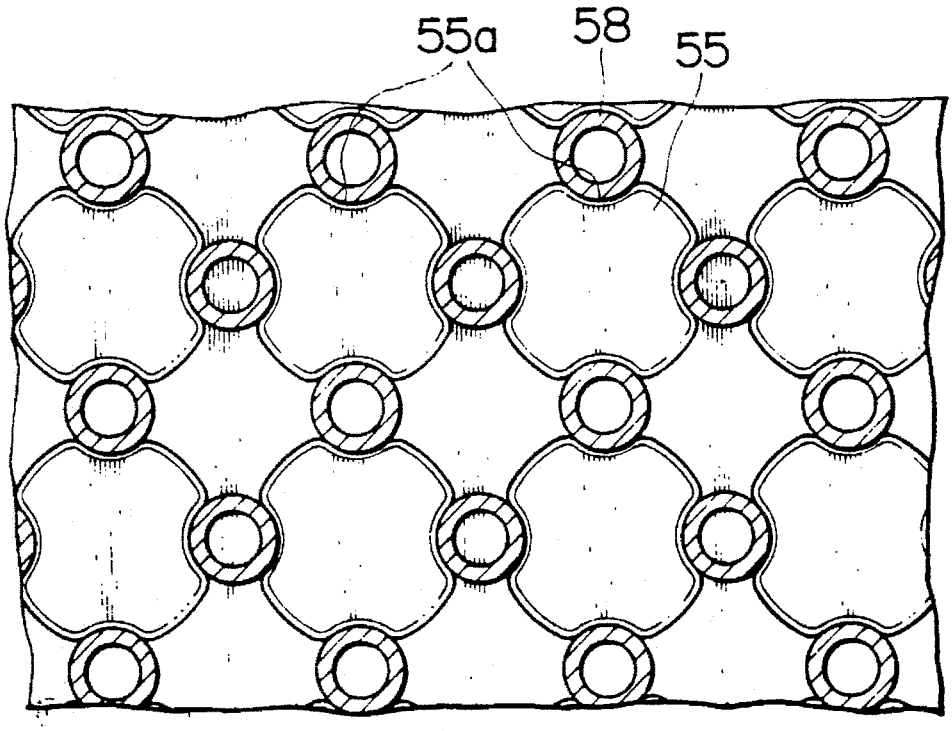
FIG. 16 is a cross sectional view of the heat exchanger depicted in FIG. 15, taken along line XVI—XVI of FIG. 15.

FIGS. 15 and 16 depict a modification of the third embodiment. In this modification, a plurality of protrusion portions 55 are formed on upper wall 56*a* of upper tank 56 or lower wall 57*b* of lower tank 57, that is, a wall opposite to lower wall 56*b* or upper wall 57*a* through which heat transfer tubes 58 extend. At least one recessed portion 55*a* is formed on the periphery of each protrusion portion 55. In this embodiment, four recessed portions 55*a* are formed on the periphery of each protrusion portion 55. Each heat transfer tube 58 is brazed to recessed portion 55*a* along an outer wall of the tube 58 near tip portion 58*b*. An opening 58*c* in each heat transfer tube 58 provides a fluid communication path between the interior of the tube 58 and the interior of tank 56 or 57. As a further modification, the connection between protrusion portion 55 and heat transfer tube 58 can be enlarged to increase the strength of the connection.

Figure 17:
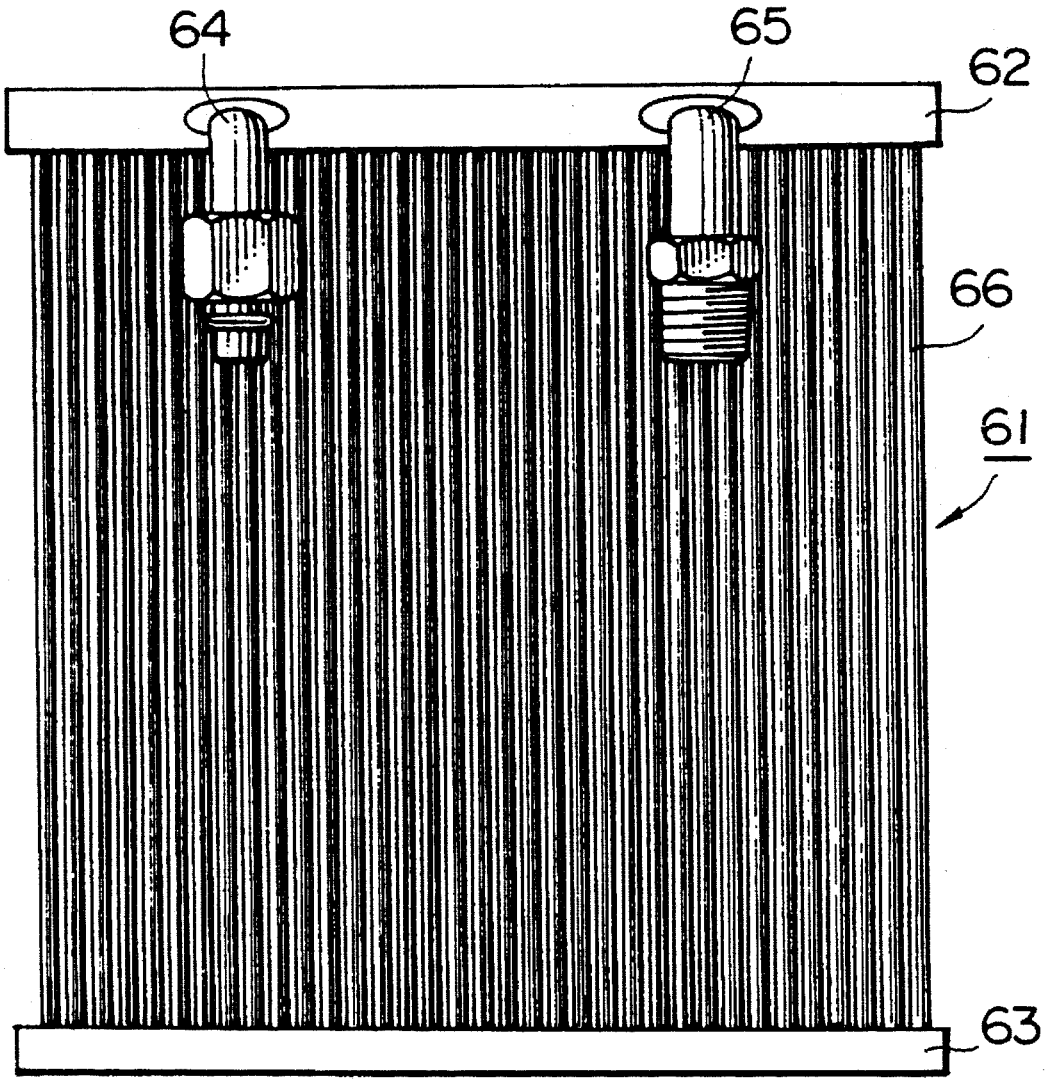
FIG. 17 is an elevational view of a heat exchanger according to a fourth preferred embodiment.
Figure 18:
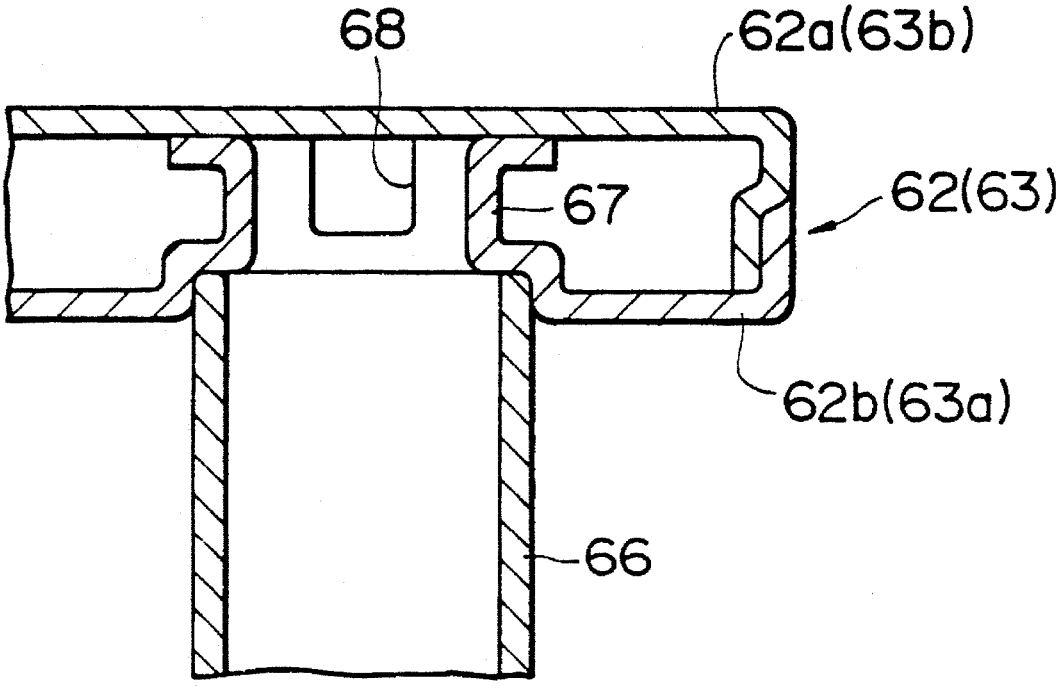
FIG. 18 is an enlarged partial vertical sectional view of the heat exchanger depicted in FIG. 17.
Figure 19:
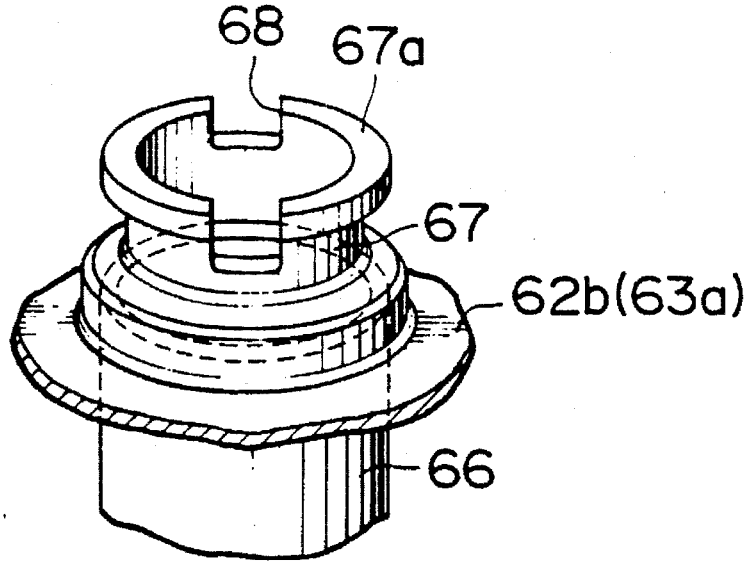
FIG. 19 is a perspective view of a cylindrical wall depicted in FIG. 18.

FIGS. 17 to 19 depict a fourth preferred embodiment. Heat exchanger 61 includes an upper tank 62 and a lower tank 63. Inlet pipe 64 and outlet pipe 65 are connected to upper tank 62. A plurality of heat transfer tubes 66 (for example, refrigerant tubes) are fluidly interconnected between tanks 62 and 63. Upper tanks 62 comprises an upper wall 62*a* and a lower wall 62*b*. Lower tank 63 comprises an upper wall 63*a* and a lower wall 63*b*. Each heat transfer tube 66 extends between lower wall 62*b* of upper tank 62 and upper wall 63*a* of lower tank 63. A plurality of cylindrical walls 67 are formed on lower wall 62*b* of upper tank 62 and upper wall 63*a* of lower tank 63 by deforming the walls themselves. Each cylindrical wall 67 is formed so that, when assembled, it surrounds the end of corresponding heat transfer tube 66. Cylindrical walls 67 project toward and extend to an opposite wall, that is, upper wall 62*a* or lower wall 63*b*. Openings 68 are defined on each cylindrical wall 67 so as to provide a fluid communication path between the interior of tube 66 and the interior of the cylindrical wall 67 and the interior of tank 62 or 63. Tip 67*a* of each cylindrical wall 67 is preferably connected to the inner surface of upper wall 62*a* or lower wall 63*b*. The tip portions of heat transfer tube 66 are preferably inserted into and abuttingly engage a stepped portion of each cylindrical wall 67.

Since upper and lower walls of tank 52 or 53 are connected by the cylindrical wail 67, tanks 52 and 53 are effectively reinforced to withstand the internal pressure of the working fluid. Cylindrical walls 67 can be formed easily by, for example, pressing. As an alternative heat exchanger configuration, only selected portions of tanks 62, 63 might be manufactured with cylindrical walls 67.

Figure 20:
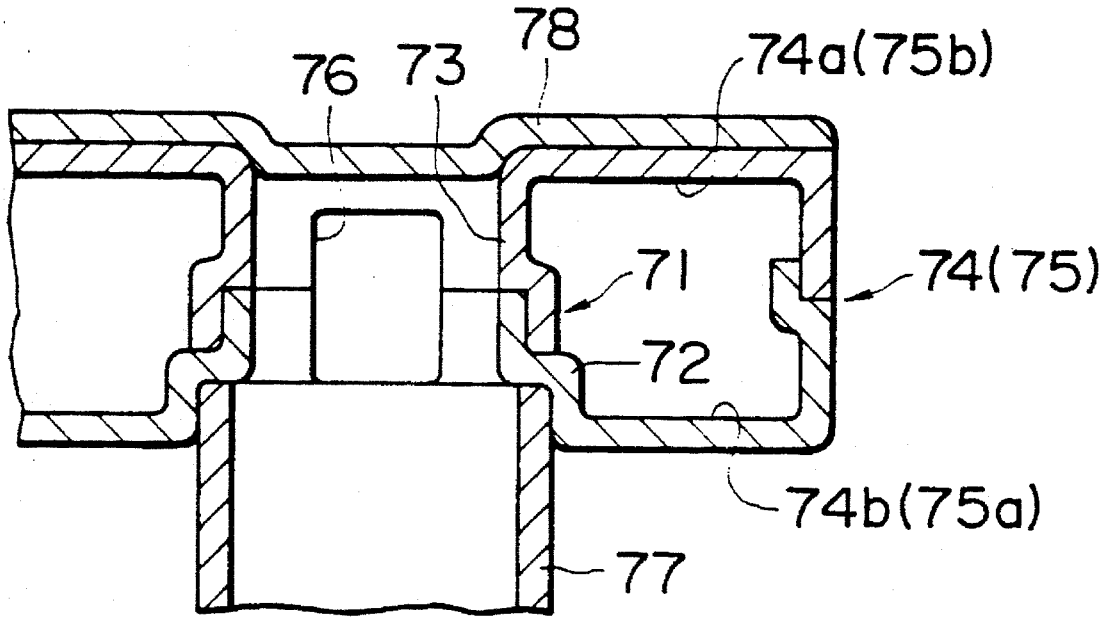
FIG. 20 is a partial vertical sectional view of a heat exchanger according to a modification of the heat exchanger depicted in FIG. 18.
Figure 21:
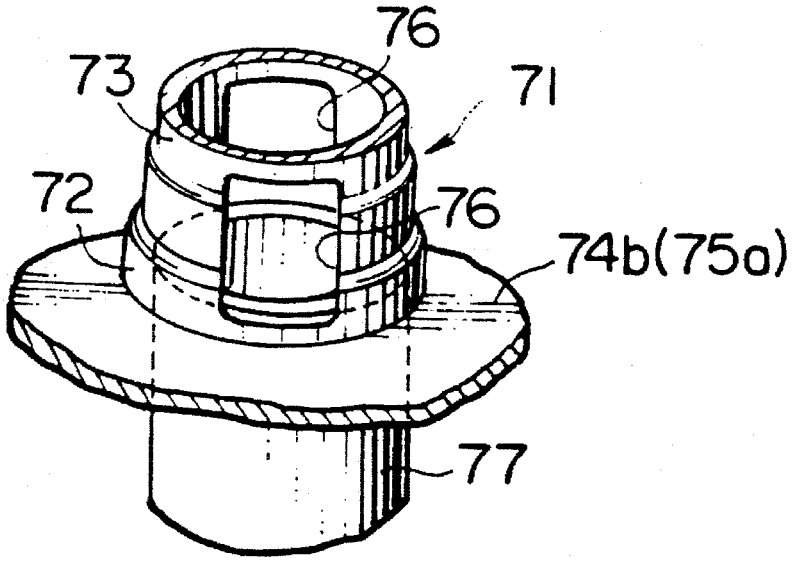
FIG. 21 is a perspective view of a cylindrical wall depicted in FIG. 20.

FIGS. 20 and 21 depict a modification of the fourth embodiment. In this modification, cylindrical wall 71 comprises a first cylindrical wall 72 formed from lower wall 74*b* of upper tank 74 or upper wall 75*a* of lower tank 75 and a second cylindrical wall 73 formed from upper wall 74*a* of upper tank 74 or lower wall 75*b* of lower tank 75. First cylindrical wall 72 and second cylindrical wall 73 are brazed to each other. Openings 76 are formed on each cylindrical wall 71 to provide a fluid communication path between the interior of cylindrical wall 71 and the interior of tank 74 or 75. The tip portions of heat transfer tube 77 are preferably inserted into and abuttingly engage a stepped portion of each first cylindrical wall 72. A plug plate 78 is provided on upper wall 74*a* or lower wall 74*b* to close the end of each cylindrical wall 71. In such a structure, advantages similar to those according to the fourth embodiment are obtained.

Figure 22:
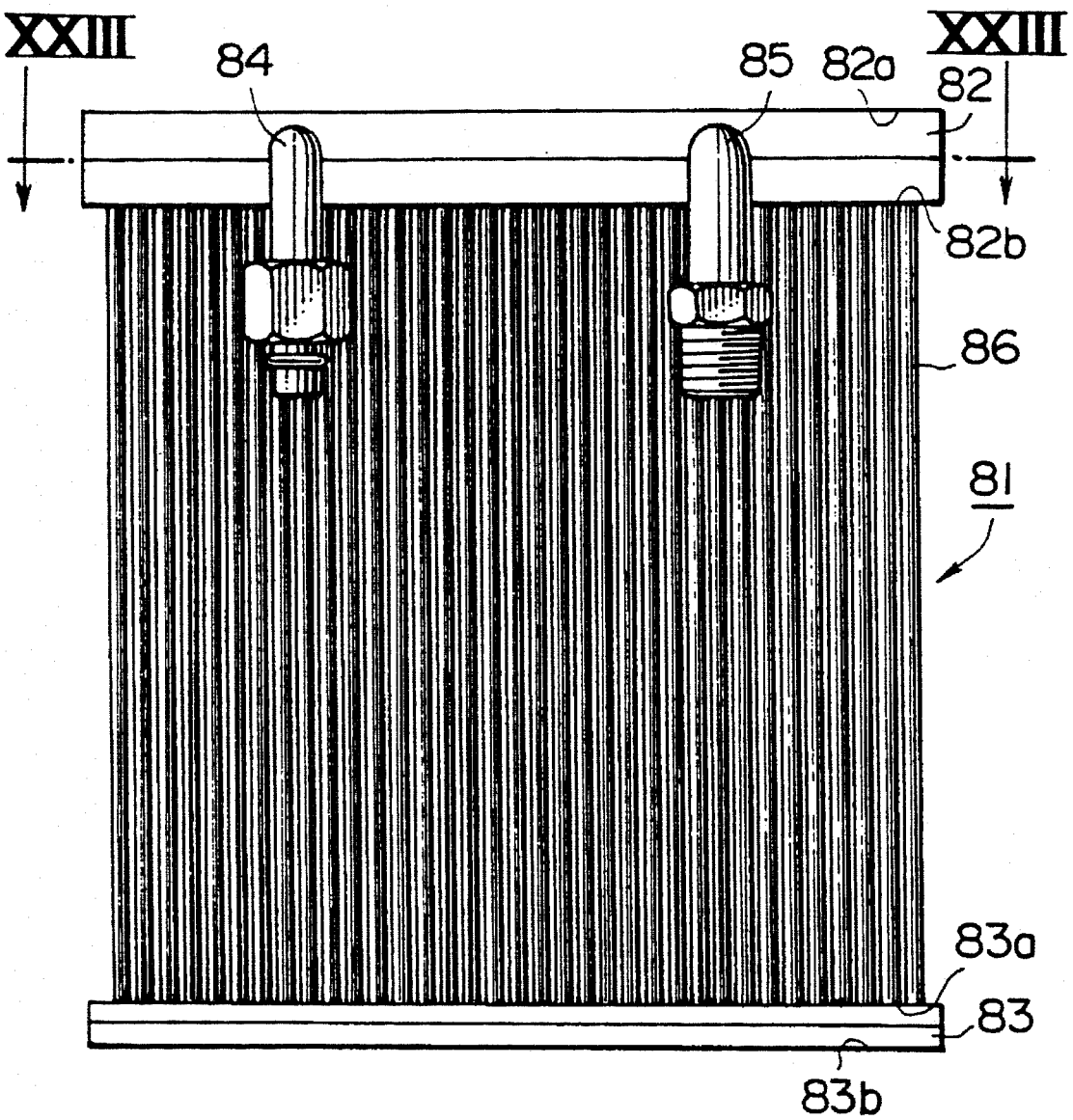
FIG. 22 is an elevational view of a heat exchanger according to a fifth preferred embodiment.
Figure 23:
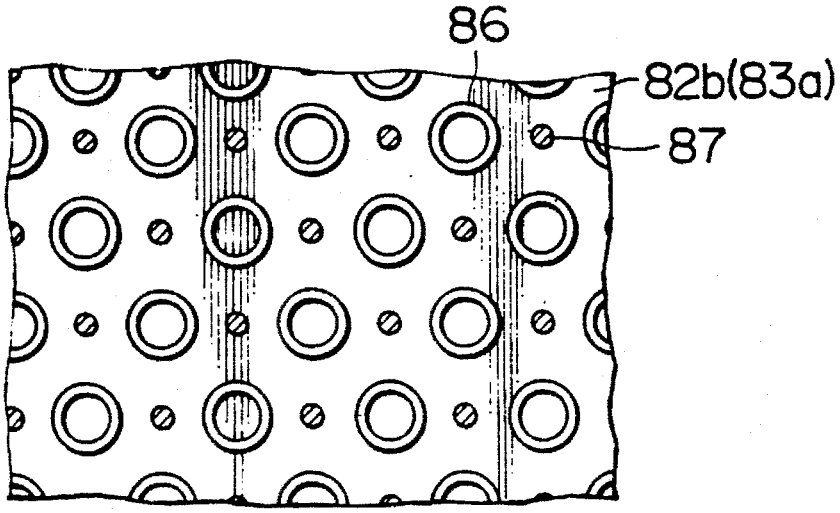
FIG. 23 is an enlarged partial cross sectional view of the heat exchanger depicted in FIG. 22, taken along line XXIII—XXIII of FIG. 22.
Figure 24:
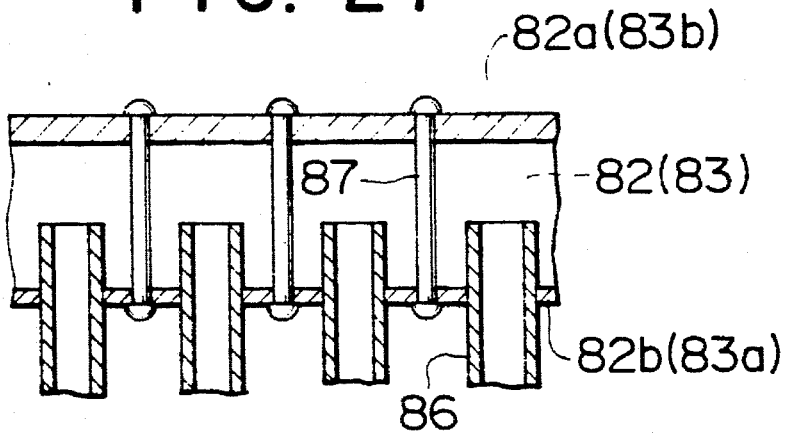
FIG. 24 is a vertical sectional view of the heat exchanger depicted in FIG. 23.

FIGS. 22 to 24 depict a fifth preferred embodiment. Heat exchanger 81 includes an upper tank 82 and a lower tank 83. Inlet pipe 84 and outlet pipe 85 are connected to upper tank 82. A plurality of heat transfer tubes 86 (for example, refrigerant tubes) are fluidly interconnected between tanks 82 and 83. Upper tank 82 comprises an upper wall 82*a* and a lower wall 82*b*. Lower tank 83 comprises an upper wall 83*a* and a lower wall 83*b*. Each heat transfer tubes 86 extend between lower wall 82*b* of upper tank 82 and upper wall 83*a* of lower tank 83. A plurality of column members 87 are provided between heat transfer tubes 86. In this embodiment, column member 87 is constructed from a pin. Each pin 87 extends between upper wall 82*a* and lower wall 82*b* of upper tank 82 and between upper wall 83*a* and lower wall 83*b* of lower tank 83. Further, each pin 87 extends through both walls of each tank 82, 83. Each end portion of pin 87 projecting from the outer surface of the tank wall is caulked thereon. Further, in this embodiment, each caulked portion is brazed to the outer surface of the tank wall. A fluid communication path is realized between pins 87.

Since column members 87 have a relatively small diameter, they occupy a small space between tubes 86. Consequently, the provision of column members 87 does not require a change in the pitch of the arrangement, i.e., spacing, of heat transfer tubes 86. As a result, the strength and resistance to deformation of tanks 82 and 83 is effectively increased.

Figure 25:
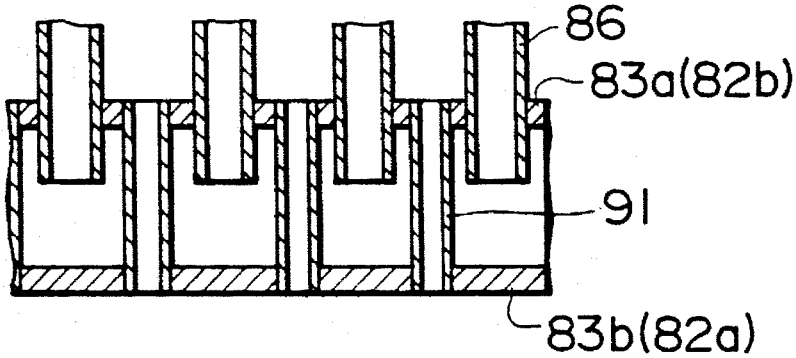
FIG. 25 is a partial vertical sectional view of a heat exchanger according to a modification of the heat exchanger depicted in FIG. 24.
Figure 26:
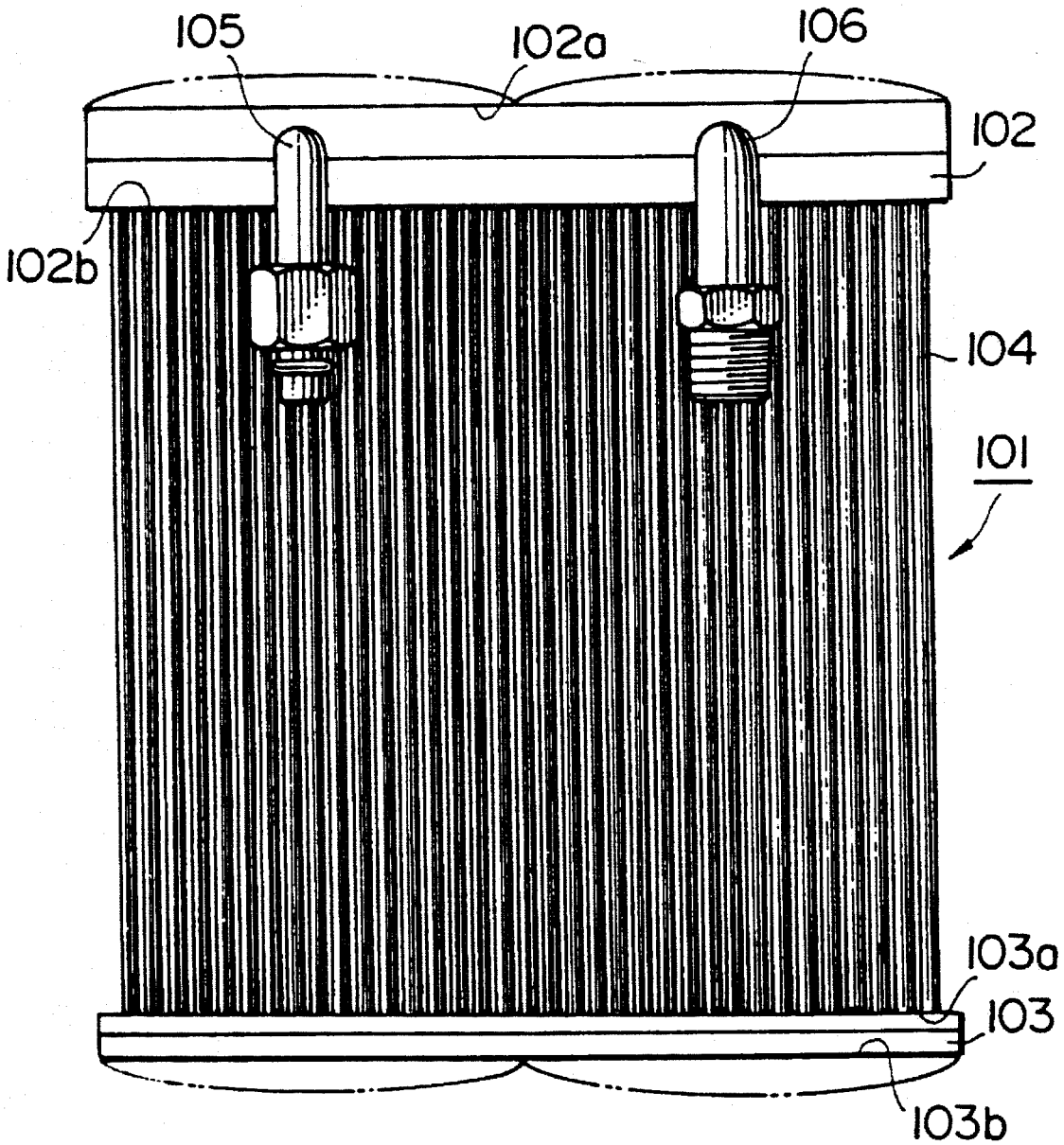
FIG. 26 PRIOR ART
FIG. 26 is an elevational view of a conventional heat exchanger.
Figure 27:
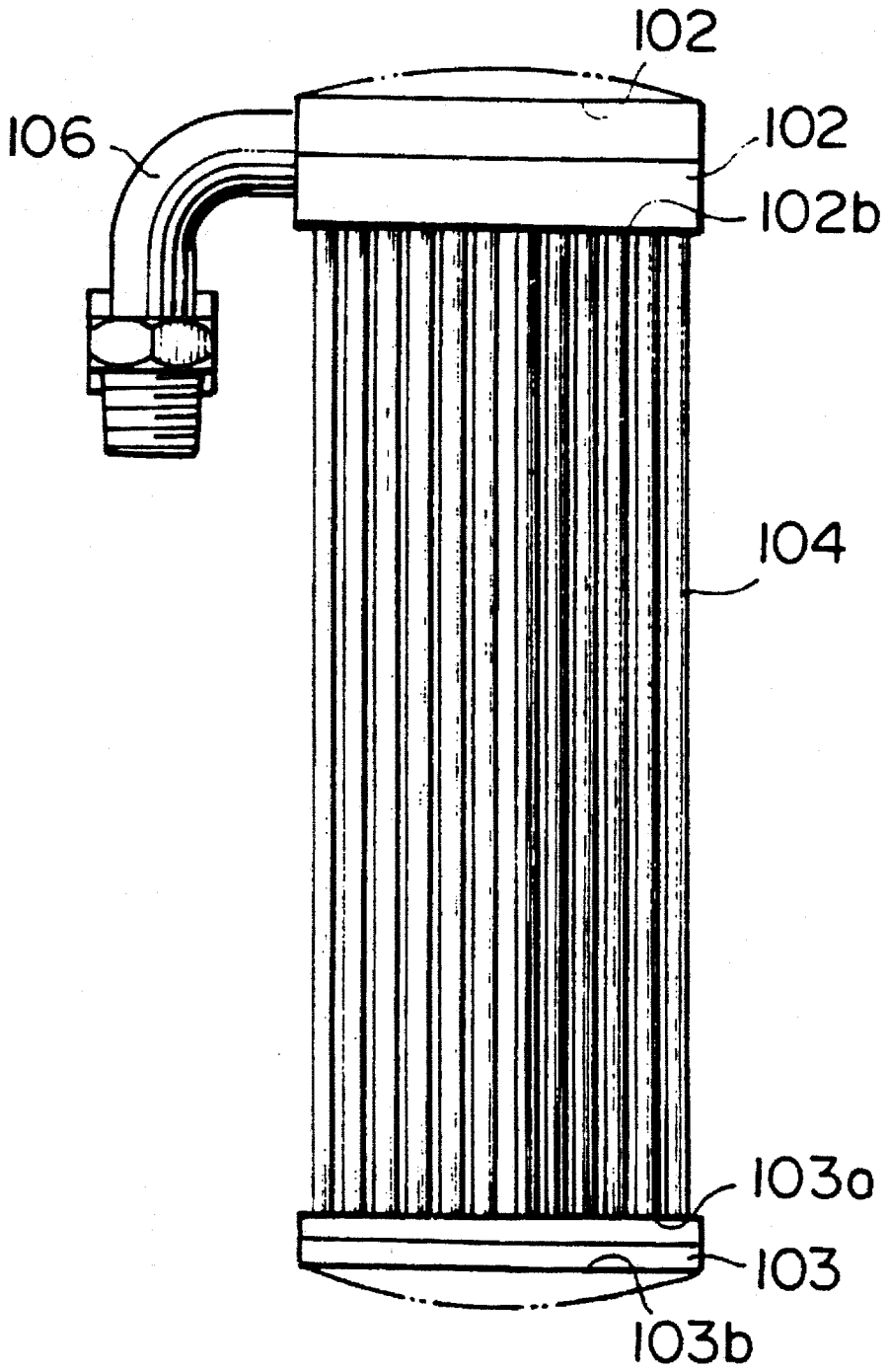
FIG. 27 PRIOR ART
FIG. 27 is a side view of the heat exchanger depicted in FIG. 26.
Figure 28:
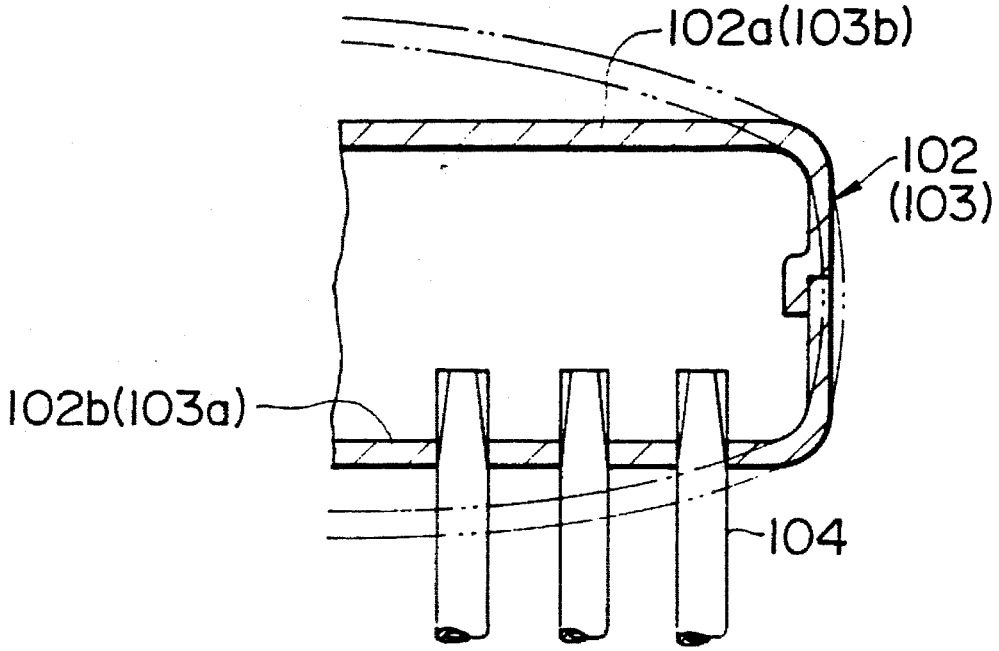
FIG. 28 PRIOR ART
FIG. 28 is an enlarged partial vertical sectional view of the heat exchanger depicted in FIG. 26.
Figure 29:
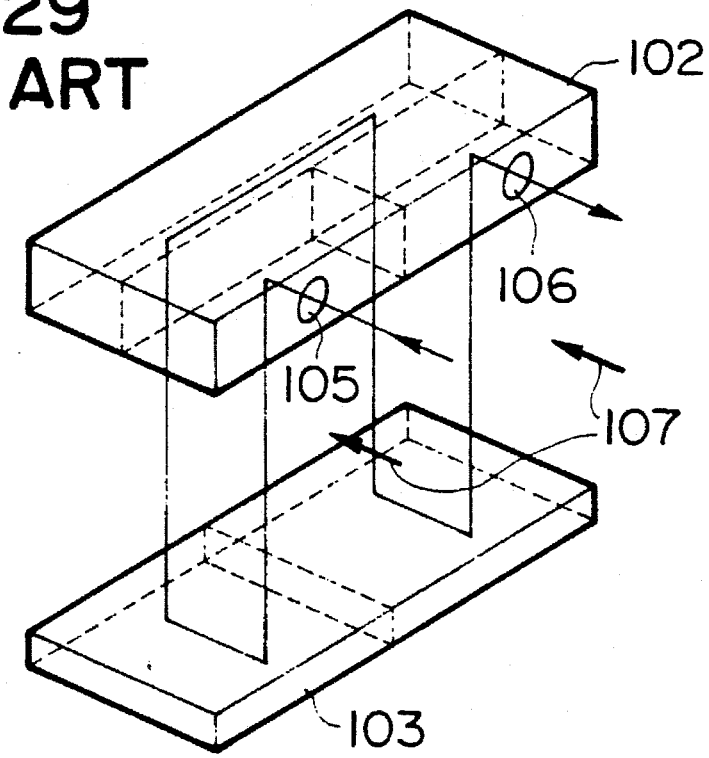
FIG. 29 PRIOR ART
FIG. 29 is a schematic perspective view of a conventional heat exchanger, showing an example of a heat medium flow.

FIG. 25 depicts a modification of the fifth embodiment. In this modification, column member 91 comprises a hollow pipe. Each pipe 91 is preferably connected to upper wall 82*a* and lower wall 82*b* of upper tank 82 or upper wall 83*a* and lower wall 83*b* of lower tank 83. Where this modified reinforcement configuration is applied to lower tank 83, water which has condensed on heat transfer tubes 86 can be discharged through the hollow portions of pipes 91 without significantly accumulating on upper wall 83*a* of upper tank 83.

Although several preferred embodiments of the present invention have been described in detail herein, the invention is not limited thereto. It will be appreciated by those skilled in the art that various modifications can be made without materially departing from the novel and advantageous teachings of the invention. Accordingly, the embodiments disclosed herein are by way of example only. It is to be understood that the scope of the invention is not to be limited thereby, but is to be determined by the claims which follow.

What is claimed is:

1. A heat exchanger comprising:

an upper tank:

a lower tank spaced from said upper tank;

a plurality of parallel heat transfer tubes fluidly interconnected between said upper and lower tanks;

means for reinforcing at least one of said upper and lower tanks by connecting an upper wall and a lower wall of said at least one of said upper and lower tanks: and a communication path associated with each of said reinforcing means, said communication path providing fluid communication between the interior of each heat transfer tube and the interior of said at least one of said upper and lower tanks;

said reinforcing means comprising a tip portion of each of said plurality of heat transfer tubes, said tip portion extending into the interior of said at least one of said upper and lower tanks through one of said upper and lower walls and connected to the wall opposite the wall through which said tip portion extends, said communication path comprising an opening on a portion of said heat transfer tube positioned in said interior of said at least one of said upper and lower tanks;

wherein a stepped portion is formed on each of said heat transfer tubes, said stepped portion abuttingly engaging an outer surface of said one of said upper and lower walls of said at least one of said upper and lower tanks.

2. The heat exchanger of claim 1, wherein said opening is formed at a position near said opposite wall.

3. The heat exchanger of claim 1, wherein each of said heat transfer tubes is brazed to said upper and lower walls of said at least one of said upper and lower tanks.

* * * * *